United States Patent [19]

Fölser et al.

[11] 4,043,398

[45] Aug. 23, 1977

[54] MOBILE BALLAST CLEANING MACHINE

[75] Inventors: Karl Fölser, Linz-Urfahr; Josef Theurer, Vienna, both of Austria

[73] Assignee: Franz Plasser Bahnbaumaschinen-Industrie-Gesellschaft m.b.H., Vienna, Austria

[21] Appl. No.: 641,749

[22] Filed: Dec. 18, 1975

Related U.S. Application Data

[63] Continuation-in-part of Ser. No. 597,414, July 21, 1975.

[30] Foreign Application Priority Data

Jan. 10, 1975 Austria ..... 135/75
Aug. 14, 1974 Austria ..... 6688/74

[51] Int. Cl.[2] ..... F01B 27/00
[52] U.S. Cl. ..... 171/16; 37/104; 104/7 R
[58] Field of Search ..... 171/16; 37/104–107; 104/7 R, 7 A; 198/139, 208

[56] References Cited

U.S. PATENT DOCUMENTS

| | | | |
|---|---|---|---|
| 3,612,184 | 10/1971 | Plasser et al. | 171/16 |
| 3,685,589 | 8/1972 | Plasser et al. | 171/16 |
| 3,850,251 | 11/1974 | Plasser et al. | 171/16 |
| 3,872,929 | 3/1975 | Teurer | 171/16 |
| 3,957,000 | 5/1976 | Plasser et al. | 171/16 |

*Primary Examiner*—Russell R. Kinsey
*Attorney, Agent, or Firm*—Kurt Kelman

[57] ABSTRACT

A mobile ballast cleaning machine useful for work in track switches and crossings comprises an endless ballast excavation chain including a chain stringer mounted in a transversely extending guide for excavating ballast underneath the track. The guide is adjustable to selected lengths for a corresponding change in the width of the ballast excavation. The excavated ballast is received on a ballast cleaning screen separating the ballast from fines to produce clean ballast, and cleaned ballast distributing conveyors and/or chutes are adjustably mounted for enabling the cleaned ballast to be distributed over the entire width of ballast excavation for selectively distributing the ballast within this width. The excavation chain and/or the distributing conveyors are mounted on mobile supports.

13 Claims, 7 Drawing Figures

MOBILE BALLAST CLEANING MACHINE

This is a continuation-in-part of our copending application Ser. No. 597,414 filed July 21, 1975.

The present invention relates to improvements in a mobile track maintenance machine useful for work in track switches and crossings, and more particularly to a machine for receiving excavated particulate track bed materials, such as ballast mixed with rubble, sand and like fines, separating the ballast from the rubble and sand to produce cleaned ballast, distributing the separated materials, and depositing the cleaned ballast and, if desired, the sand on the subgrade.

Ballast cleaning machines of this general type are known which comprise an endless ballast excavation chain including a chain stringer mounted for extension transversely of, and below, the track for excavating ballast supporting the track on a subgrade. Such known ballast cleaning machines also include screen means for separating the excavated ballast from fines to produce cleaned ballast, and conveyor and/or chute means for distributing the cleaned ballast and the fines in desired patterns. Such known excavation chains have additional chain stringers, the chain stringers being arranged for movement in a polygonal path, and a correspondingly polygonal chain guide assembly including the transversely extending guide and additional guides one preceding and one following the transversely extending guide in the direction of chain movement. The additional guides lead to the ballast cleaning screen means where the excavated ballast is separated into cleaned ballast, rubble and, if present, sand, the rubble is taken away to be distributed laterally along the right of way for subsequent removal or is conveyed into freight cars coupled to the mobile ballast cleaning machine frontwards and/or backwards thereof, and the cleaned ballast and, if present, the sand are deposited again on the subgrade in the region of excavation, with the sand laid down first in a blanket and the ballast distributed thereover.

Ballast cleaning machines of this type, which operate within the boundaries of one track as they move therealong during the cleaning operation, have been well received in the industry for track maintenance work. However, they cannot operate in track sections exceeding a normal track width, for instance where extra-long ties are used and/or in the region of a track switch or crossing and the like, because the ballast excavation width in these situations substantially exceeds the normal width of a track bed. Therefore, the excavation chain cannot operate under the track of tracks of such widened regions, and neither the excavation nor the distributing means are designed to work over such widths.

In an effort to make automatic ballast cleaning in widened track regions possible, a machine has been proposed which comprises an excavation chain which may be pivoted about a vertical fulcrum to extend transversely below the track to excavate ballast and then to deposit the excavated ballast in the region of the edge of the track bed laterally adjacent the end of the ties, the chain being designed to cut like a sword into the ballast during pivoting. However, the excavation chain is not guided over a relatively wide track region since it is pivoted on a laterally projecting bracket and, therefore, would be under an unacceptably heavy load if too wide. Therefore, if this known machine were used for excavating ballast under a track switch, it would first have to be operated to remove the ballast under one of the tracks and, in a second operating stage, the machine would have to be run over the branch track to excavate the ballast thereunder. Furthermore, this machine requires separate means for receiving and conveying the excavated ballast from the edge of the bed to a ballast cleaning screen.

In U.S. Pat. No. 3,850,251, dated Nov. 26, 1974, a mobile ballast cleaning machine has been disclosed which avoids the need for two separate means for excavating ballast from underneath a track switch and for conveying the excavated ballast to a cleaning screen. In this machine, the excavation width of the excavation chain stringer running transversely below the track may be adjusted by pivoting two chain guides in relation to each other, the larger the angle therebetween the greater the excavation width. However, since the length of the chain guides remains unchanged, regardless of the desired excavation width, additional supports and guides are needed for the endless chain. This complicates the machine structure and also requires a chain drive of very high capacity.

It is the primary object of this invention to provide a mobile track maintenance machine of the first-described type which is useful for work not only in regular track sections but also in regions of switches and crossings, the effective excavation width of the chain being changeable relatively simply and quickly so that highly economic operation of the entire ballast renewal process may be effectuated.

It is a further object of the invention to provide such an improved ballast cleaning machine by using structural parts already used in commercially operating machines.

The above and other objects are accomplished in accordance with the present invention with a transversely extending guide for the transverse excavation chain stringer which is adjustable in length for selectively changing the width of the ballast excavation effectuated by the chain stringer, and the means for distributing the cleaned ballast is adjustable over the entire width of the ballast excavation for selectively distributing the cleaned ballast within this width, mobile support means being provided for supporting the excavation chain and preferably also the distributing means during movement of the machine. The support means is mounted for mobility on the subgrade from which the ballast has been excavated or on the branch track of the switch.

This construction makes it possible to adapt the length of the chain guide readily to the required excavation width and similarly to adapt the positioning of the ballast distributing means to changing bed widths, for instance in track switches, the mobile support absorbing any tilting moments and eccentric forces arising even with a greatly extended chain guide projecting laterally considerably beyond the machine frame. Furthermore, since the length of the chain guide and preferably of the chain is adjustable, the capacity of the chain drive may be adapted to the varying needs and the speed of the chain movement may be adjusted to the adjusted excavation width. This considerably increases the speed of the excavation and conveying of the excavated ballast in difficult track regions and this improves the economy of the entire operation. The adaptability of the machine also makes it possible to continue the use of the same machine in straight track sections adjoining a switch without making too many or difficult adjustments, thus for the first time providing a universally usefull ballast cleaning machine which can operate on straight track, track switches, extra-wide track and even over two parallel tracks.

The above and other objects, advantages and features of this invention will become more apparent from the following detailed description of preferred embodiments of the invention, taken in conjunction with the accompanying drawing wherein FIG. 1 is a side elevational view of a mobile track maintenance machine according to the present invention;

Figures 1, 2, 3, 4:
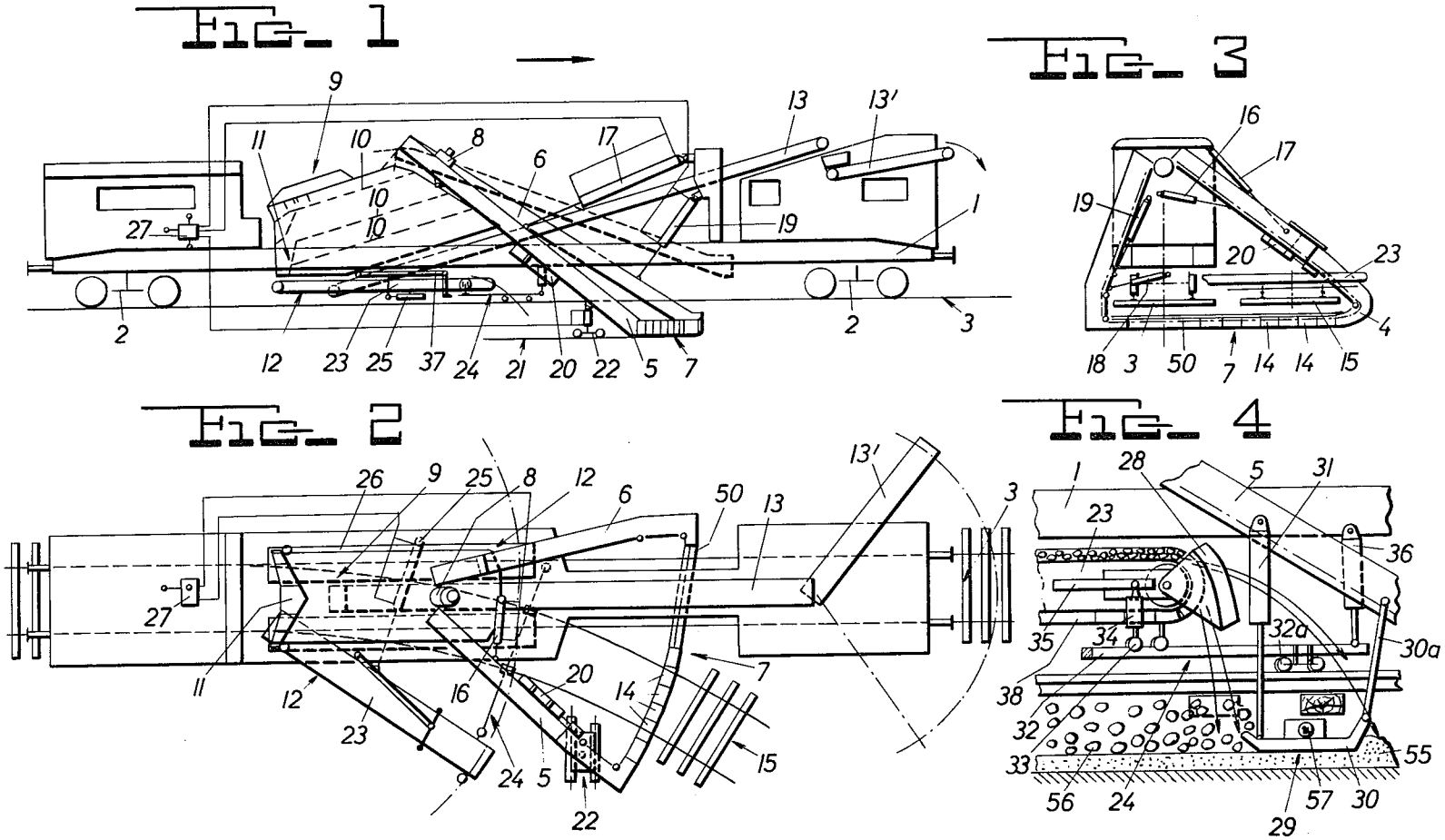
FIG. 2 is a top view of the machine of FIG. 1.
FIG. 3 is a front view of the machine, seen in the operating direction of the machine, the ballast cleaning screen being removed for a better understanding of the essential parts of the machine.
FIG. 4 is an enlarged partial side view of the machine, showing a modified support for the chain guide.

Referring now to the drawing and first to FIGS. 1 and 2, there is shown a mobile ballast cleaning machine similar to that disclosed in our copending application. This machine comprises frame 1 which is supported on swivel trucks or undercarriages 2, for mobility on the rails of track 3. The track rails are fastened to ties supported on subgrade 21 by ballast. The machine moves on the track in the direction of the horizontal arrow shown in FIG. 1 during the ballast cleaning operation. Ballast excavation chain 4 is mounted on machine frame 1 to remove dirty ballast from the ballast bed on which the track rests. The endless ballast excavation chain comprises a first stringer mounted for extension transversely of, and below, the track for excavating the dirty ballast and additional stringers all arranged for movement in a polygonal path, a triangular configuration being illustrated. The additional stringers are arranged laterally of the machine frame and extend from respective ends of the transverse stringer. Guide rollers or sprockets are mounted at the ends for guiding the stringers in the triangular path. The endless excavation chain is supported in a chain guide assembly including transversely extending guide 7, and additional guides 5 and 6, respectively extending rearwardly from guide 7 and following it in the direction of chain movement. The two longitudinally extending chain guides 5 and 6 rise from transverse chain guide 7 and are arranged in a plane extending obliquely to the track plane. A universal pivot mounts the upper ends of chain guides 5 and 6 on machine frame 1 for permitting vertical as well as lateral pivoting of the excavation chain. Chain drive 8, is mounted at the adjacent upper ends of chain guides 5 and 6, and the endless excavation chain is trained over the drum which pulls one of the laterally arranged chain stringers along guide 6 therefor to convey the excavated ballast to ballast cleaning screen 9 subtending the upper ends of the guide assembly while the other laterally extending endless chain stringer passes without load along chain guide 5.

As shown in FIG. 1, preferred screening means 9 for separating the excavated ballast from fines, such as rubble and sand, consists of three superposed screening elements 10 constituted by chutes extending obliquely to the plane of the track. The cleaned ballast is gravity-fed from the intermediate screen 10 to cleaned ballast distributing means 11 which is a chute gravity-feeding the ballast to conveyor means 12 which delivers and distributes the cleaned ballast over the excavated section of the track bed. The rubble separated from the cleaned ballast is deposited on conveyor means 13,13' which delivers and distributes the rubble laterally along the track bed edges or drops it into freight cars (not shown) coupled to the machine.

As best illustrated in FIGS. 2 and 3, and disclosed in detail in our copending application whose disclosure is incorporated herein by reference transversely extending chain guide 7 is comprised of a fixed main member 50 and removable members 14 to make the length of this guide adjustable by insertion of a desired number of additional members, preferably up to eight or nine, and to fix this guide length so as selectively to change the width of the ballast excavation effectuated by the transverse chain stringer moving below the track in accordance to local track conditions. For instance, as shown in FIG. 2, the excavation chain has been widened so as to enable it to excavate ballast simultaneously under main track 3 and branch track 15, thus cleaning out the entire switch in one operation and moving the excavated ballast in the same operation to the cleaning screen 9.

Hydraulic motors 16, 17 are linked, respectively, to machine frame 1 and guide 5, and hydraulic motors 18, 19 are similarly linked to the machine frame and guide 6 for pivoting the guides in a vertical and lateral direction, motors 16 and 18 serving to spread the two longitudinal chain guides apart transversely of the track to permit insertion of the desired number of guide members 14 in transverse guide 7 and then to move the two guides 5 and 6 together again after the additional guide members have been inserted to fix the length of guide 7. The additional guide members are inserted in guide 7 between fixed guide member 50 and pivotal guide 5, wherealong the chain runs without load, so that guide 7 is lengthened towards the right, as seen in the operating direction of the machine, so as to extend the excavation width to branch track 15. Useful structures for the additional guide members 14 and the manner of inserting them in the guide are more fully disclosed in our copending application whose disclosure is incorporated herein by reference.

As also more fully disclosed in our copending application, excavation chain 4 may be tensioned after the additional guide members have been inserted and relaxed before such insertion by means of a chain tensioning device. For this purpose, chain guide 5 is comprised of two parts movable in relation to each other in the direction of chain elongation and the two guide parts may be moved in this direction by a preferably hydraulic drive 20 to shorten or lengthen guide 5. This structure is fully described and claimed in our copending application and provides particularly simple means for adjusting the excavation width of the chain and for keeping the chain tensioned under all operating conditions. Increasing the length of transverse chain guide 7 in the direction of the chain guide 6 which is free of a load reduces the eccentric tilting moments as the chain guide is laterally extended to project considerably beyond the machine frame towards branch track 15. Additional mechanical blocking devices may, therefore, be omitted since the hydraulic drives enable even large forces to be transmitted in the region of the chain guide assembly.

FIGS. 1 and 2 show mobile support means 22 pivotally carrying the excavation chain and, more particularly, chain guide 5 for guiding and supporting the chain at a predetermined vertical portion during movement of the machine along track 3. The illustrated support is mounted on wheels or rollers running on subgrade 21 which has previously been cleared of ballast by the excavation chain, the cleaned ballast being deposited on the subgrade by conveyor 23 behind support 22, as seen in the operating direction. This support assures a stable adjustment and guidance of the chain guide assembly and its transverse guide 7 at the desired vertical position even when guide 5 has been laterally pivoted to a considerable extent to move it beyond branch track 15, for instance.

As FIG. 2 illustrates, distributing means 12 for the cleaned ballast, which is constituted by a pair of like endless conveyor bands 23 and 26, is adjustable over the entire width of ballast excavation, i.e. the conveyor bands may be laterally pivoted sufficiently to permit redistribution of the cleaned ballast within this entire width, including branch track 15, for example. This arrangement makes it possible not only to excavate a wide area in one operation but also to redistribute the cleaned ballast over the entire area evenly while the machine advances along track 3. It is useful also to provide a support for conveyor band 23 to hold it at a predetermined vertical position and to guide it in all pivotal positions so as to absorb the relatively large eccentric forces arising when the conveyor band is laterally pivoted. Illustrated mobile support 24 for the conveyor band runs on rollers on track 3 but it may also be supported on the subgrade or track 15, as may be desired.

The illustrated means for adjusting distributing conveyor 23 between its end positions shown respectively in full and broken lines, is hydraulic motor 25 linked respectively to frame 1 and the conveyor.

The cleaned ballast distributing chute 11 has two discharge branches (see FIG. 2) one of which gravity-feeds cleaned ballast to one end of pivotal conveyor band 23 at one side of track 3 while the other discharge branch of chute 11 gravity-feeds cleaned ballast coming from cleaning screen 9 to second endless conveyor band 26 at the opposite side of track 3, the hydraulic motor for pivoting conveyor band 26 in a substantially horizontal plane similarly to conveyor 23 having been omitted from FIG. 2 for the sake of clarity.

The machine is operated from a central control console 27, an electric control circuit leading from the console to control valves in a hydraulic circuit supplying motors 16 to 19 for suitably pivoting chain guides 5 and 6, the motors for laterally pivoting conveyors 23 and 26, and hydraulic jacks on supports 22 and 24 for adjusting the height of the chain guide assembly and the distributing conveyors.

FIG. 4 partly schematically illustrates an arrangement of conveyor band 23 (which is also applicable to conveyor 26) adapted to enable a sand blanket 55 to be laid down on subgrade 21 before the cleaned ballast 56 is redistributed in the excavated track bed. During excavation, the sand and dirty ballast are removed from the bed by chain 4, and they are conveyed in admixture to screen 9 where they are separated, the separated sand and the cleaned ballast then being delivered sequentially in the direction of machine operation in a manner described, for instance, in U.S. Pat. No. 3,872,929. In this arrangement, a pivotal hood 28 is mounted on conveyor 23 at the discharge end thereof which, as shown by the downwardly pointing arrows in FIG. 4, delimits the range of the cleaned ballast 56 thrown off the conveyor band into the track bed. In this manner, sand 55 is first laid down on subgrade 21 and the cleaned ballast is then deposited on the sand blanket.

FIG. 4 also shows a modified mobile support 29 for guide 5. This support consists of a sled-like carrier 30 gliding on the subgrade or sand blanket. Chain guide 5 is pivotally carried thereon by means of link **30*a* and hydraulic jack 31 enabling the height of the chain guide to be adjusted. Carrier 30 also has mounted thereon vibrator 57 which enables the carrier to function as a planing device for the sand blanket and to compact the sand while support 29 moves with the machine along the track. This vibrator will also vibrate chain guide 5 and thus chain 4**, which will aid in loosening the dirty ballast during excavation and thus facilitate the excavation of ballast, enabling the excavation chain to be driven with relatively little power even in regions of a wide excavation width.

Mobile support 24 for distributing conveyor 23 is also shown in greater detail in FIG. 4. The illustrated support comprises guide track 32 supported on double-axled undercarriage **32*a* on track 3. Two vertical adjustment devices constituted by hydraulic jacks 34 are guided on guide track 32 by means of double-flanged rollers 33, the other ends of the hydraulic jacks having rollers guiding them in longitudinal guide 35 of conveyor 23. These jacks enable the conveyor to be vertically adjusted to a desired height. The tilting moments arising when the conveyor is laterally pivoted into the end position shown in full lines in FIG. 2 are transmitted to the heavy machine frame 1 by means of hydraulic jack 36 linking the other end of guide track 32 to the frame. The arrangement of rollers 33 and longitudinal guide 35 does not prevent the lateral pivoting of the conveyor. However, it would also be possible to omit guide track 32 and to provide a carrier 37, as schematically indicated in FIG. 1**, or to combine such a carrier with the guide track.

If it is desired, as illustrated in FIG. 4, to lay down a sand blanket for the ballast, endless conveyor band 23 is divided into two longitudinally extending halves by a center wall 38 so that the sand may be conveyed on one half of the conveyor band separately from the cleaned ballast which is simultaneously conveyed on the other conveyor band half from screen 9 to the excavated portion of the track bed.

Figure 5:
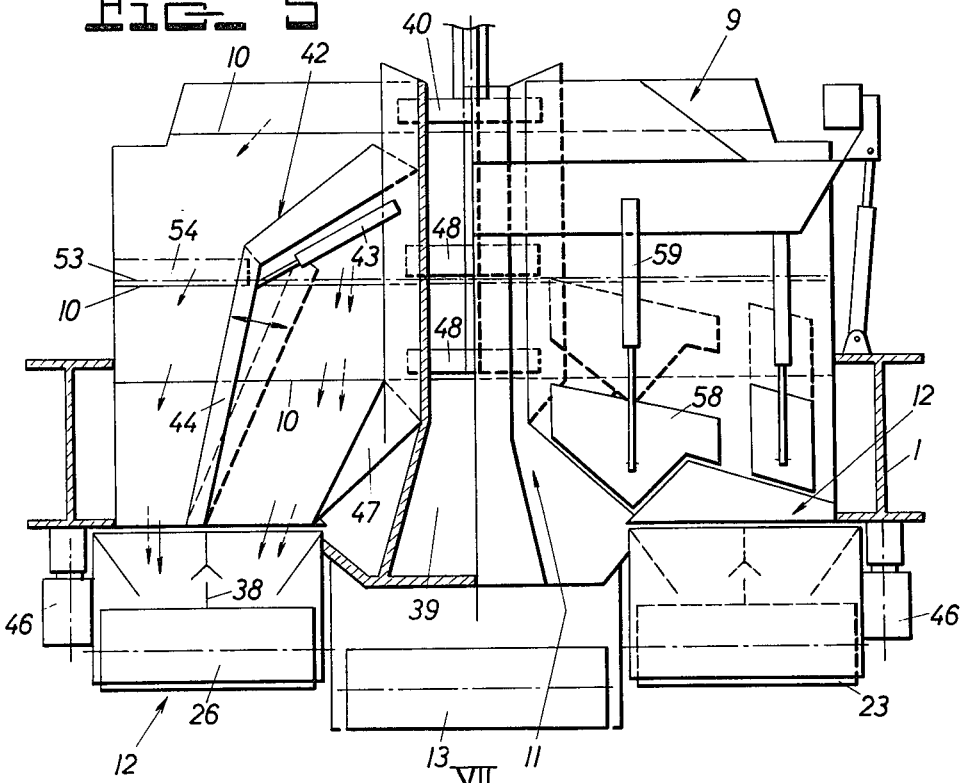
FIG. 5 shows a front view, in section along line V—V of FIG. 6, of the ballast distributing means associated with the ballast screen.
Figure 6:
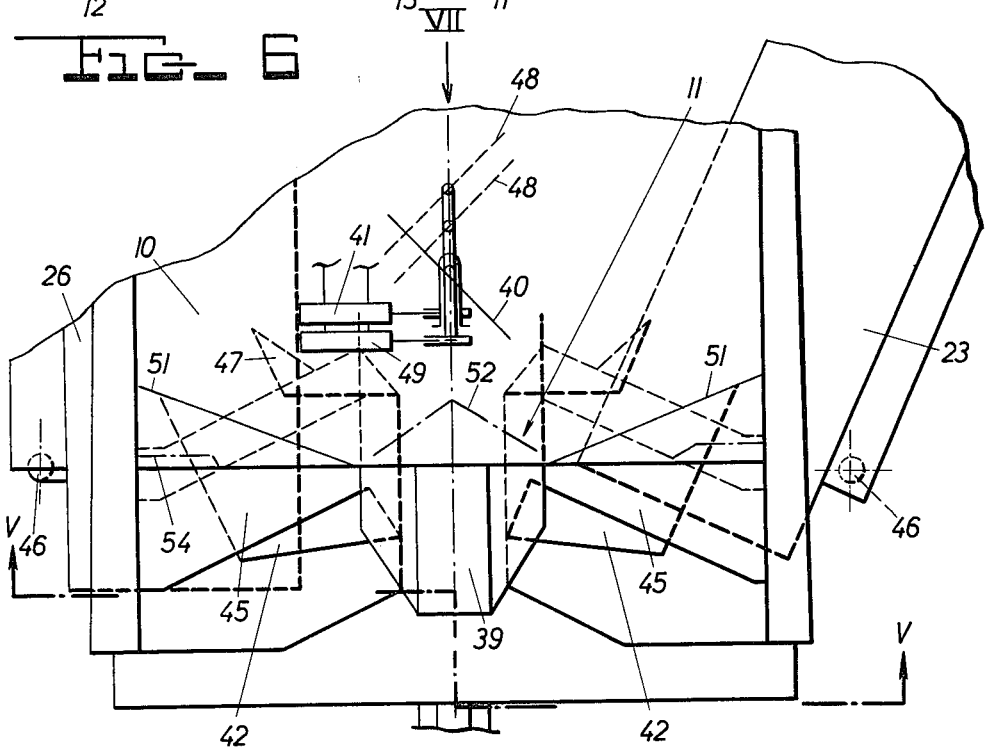
FIG. 6 is a top view of FIG. 5.
Figure 7:
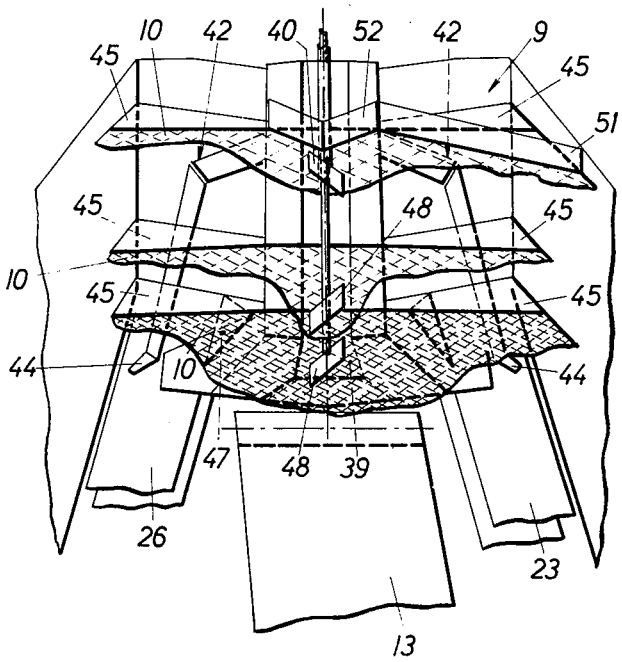
FIG. 7 is a view in the direction of arrow VII in FIG. 6.

FIGS. 5 to 7 illustrate in more detail screening means 9 for separating the excavated ballast from fines to produce cleaned ballast and means 11 for distributing the cleaned ballast and the fines. Screening apparatus 9 is resiliently mounted on machine frame 1 by means of cross beams and heavy compression springs interposed between the beams and the screening apparatus.

As shown in FIG. 1, the three-tiered screening apparatus 9 has its screens 10 downwardly inclined to gravity-feed the separated track bed materials to endless conveyors 23, 26 and 13 of the distributing means 12, conveyors 23 and 26 distributing the cleaned ballast and, if provided with center wall 38, sand in the above-described manner while conveyor 13 removes the rubble. In the illustrated embodiment, the discharge end of conveyor 13 delivers the rubble to a short swingable conveyor 13' which, as shown in FIG. 2, may throw the rubble to either side of track 3. Distributing means 12 also comprises distributing chute 11 interposed between the discharge end of the screening apparatus and the distributing conveyors. The distributing chute includes center shaft 39 receiving the coarsest track bed material portion from uppermost screen 10, a ballast guide baffle 40 being associated with this screen, as shown in FIG. 6. Hydraulic motor 41 is connected to pivotal baffle 40 to pivot the same into desired positions. A pair of chutes are arranged on each side of center shaft 39, the chutes of each pair being separated by baffle 42. The discharge ends of each pair of chutes are aligned with respective halves of conveyor bands 23 and 26 defined by center wall 38. As shown by full and broken lines in FIGS. 5 and 6, hydraulic motor 43 is connected to each baffle 42 so that a vertical part 44 thereof may be pivoted transversely to the center axis of the machine frame, thus controlling the amount of bed material delivered to each half of the conveyor bands. Rubber-lined sheet metal chutes 45 are mounted between the three screens 10 and the chutes separated by baffles 42, chutes 45 constituting triangular extensions of the screens which are inclined in relation to the track plane. As shown in the right half of FIG. 6, the rims of chutes 45 extend perpendicularly to the longitudinal axis of conveyors 23 and 26 when the conveyors are pivoted to their maximum angle in relation to the machine frame. FIG. 7 provides another view of the ballast distributing means, slide 58 with its motor 59 being omitted to improve the clarity of this view. For the same reason, motors 41 and 49, as well as guide 54, have not been shown in FIG. 7.

The operation of the machine will partly be obvious from the preceding description of preferred structional embodiments thereof and will hereinafter be set forth in some detail:

As the ballast cleaning machine advances in the direction of the horizontal arrow shown in FIG. 1 into the range of a track switch, approaching it from the "narrow" end, the length of the track ties gradually increases with the width of the ballast bed, which requires the length of transverse excavation chain stringer and corresponding chain guide 7 to be correspondingly increased to provide a greater excavation width. For this purpose, the end of chain guide 5, which is linked to one end of chain guide 7, is disconnected from guide 7 and guide 5 is pivoted away from guide 7 by hydraulic motor 16 and/or 17, to provide a gap between fixed guide member 50 or any previously inserted removable guide members 14, and guide 5 for insertion of an additional guide member 14 or a plurality of such members in this gap, depending on the desired excavation width. Each guide member 14 is mounted from behind chain 4 so that the chain must not be taken apart at this point, and each guide member is connected with the preceding guide member. At the same time, the length of chain 4 is correspondingly increased by inserting chain links in the region of drive 20, the lengthening of the chain and the chain guide being more fully described and illustrated in our copending application. In this manner, the transverse chain guide (and the chain) is increased stepwise during the excavation of the ballast until the distance between the facing ends of the ties of track 3 and branch track 15 is about 50 to 70 cm, at which point ballast cleaning proceeds separately along these two tracks. Thus, the maximal excavation width obtained with the present machine is about 6 to 7 m, for which purpose about eight to nine removable guide members 14 are required. This imparts maximum adaptability to the machine to local working conditions while keeping the machine from becoming too cumbersome and/or the guide members 14 from becoming too long or heavy.

The excavated ballast is conveyed upwardly by chain 4 and is gravity-fed to screening mechanism 9 mounted under the upper end of the chain guide assembly in the region of chain drive 8. The vibrating screens 10 separate the ballast from rubble and coarse rock to provide cleaned ballast. The rubble falls through screens 10 onto endless conveyor band 13 to be removed by conveyor 13'. If coarse rocks are also to be separated from the cleaned ballast, two guide baffles 51 (see FIG. 6) are associated with uppermost screen 10 to guide the coarse rock into shaft 39 for removal.

Ballast guide baffles 48 are associated with the two lower-most screens to transfer a sufficient amount of cleaned ballast from these screens to endless conveyor 23 to fill the track bed under track 15 in the switch region with cleaned ballast in a single operation. As shown in FIG. 6, these guide baffles may be pivoted counterclockwise to any desired degree, depending on the added number of guide members 14, so that up to two thirds of the entire cleaned ballast may be directed either to conveyor 23 or to conveyor 26. A further control of the amount of cleaned ballast in distributing device 11 may be obtained by pivoting baffle 44. The cleaned ballast thus delivered to pivotal conveyor 23 is then distributed under track 15 by suitably swinging the conveyor over the width of the track bed. Oblique chutes 45 enable the ballast conveyor to be pivoted to a maximum angle, thus adapting the direction of the chutes and the amount of the cleaned ballast to the pivotal position of the conveyor. Furthermore, the pivoting movement of conveyor 23 transversely to the track may be adapted to the length of transverse chain guide 7 and it is possible, for instance, to stop briefly when the pivotal angle of the conveyor and the excavation width are at their maximum, to make certain that sufficient cleaned ballast is deposited in the excavated track bed.

As will be appreciated from the above description, noload chain guide 5 and cleaned ballast conveyor 23 project considerably from the side of machine frame 1 at the maximum excavation width. Supports 22 (or 29) and 24 are designed to enable the machine to function without difficulty in this position, despite the strong tilting moments exerted upon the relatively light machine frame by these machine elements. In addition, support 22 (or 29) enable the excavation chain to be guided at a desired height so as to assure an even excavation depth and avoid damage to the subgrade. This reduces the time required for the ballast cleaning operation and increases the quality thereof.

Cleaned ballast may be conveyed to the excavated track bed not only by pivotal endless conveyors 23 and 26 but may be dropped into the bed directly by operating two slides mounted in the back wall of chutes forming the back wall of screen 10. A sliding gate is associated with each guide baffle 42 and each gate 58 may be vertically reciprocated by a hydraulic motor 59, as shown in full and broken lines on the right side of FIG. 5.

It should be mentioned that the ballast cleaning machine may be operated not only in the illustrated working direction but could approach a track switch also from the opposite side, i.e. from its "wide" end. This makes it possible also to excavate track bed material under crossings and crossing switches. Under these operating conditions, the machine could be operated throughout with its maximum excavation width although it is also possible to work with fewer than the maximum amount of guide members 14. Also, instead of increasing the length of the chain during lengthening of the chain guide 7, the tensioning range provided by drive 20 may be sufficient to accommodate the insertion of eight or nine additional guide members 14 even without adding any chain links.

If it is desired to use the machine for laying down sand blanket 55 without cleaning ballast, guide baffles 51 are removed from uppermost screen 10 and the discharge opening of shaft 39 is closed by hood 52 (see chain-dotted line in FIG. 6). Furthermore, a small-meshed screen is used as uppermost screen 10 and a rubber mat 53 (shown in chain-dotted lines in FIG. 5) is placed on intermediate screen 10. In this manner, the ballast remains on the uppermost screen and the sand dropping through this screen remains on the rubber mat on the intermediate screen. Additional guide baffles 54 associated with the covered intermediate screen will guide the ballast from the uppermost screen into one of the chutes divided by baffle 42 while the sand will fall into the other chute, as shown by the arrows in broken lines in FIG. 5. In this manner, each of the conveyor band halves of conveyors 23 and 26 will be supplied only with sand or ballast. In this operation, it will be advantageous to fill the cribs by use of sliding gates 58 in the oppositely facing chutes to assure proper redistribution of the ballast in the excavated bed. Simultaneously, the sand and ballast separately conveyed by conveyors 23 and 26 are sequentially deposited on the subgrade in the manner indicated in FIG. 4. In view of the fact that the conveyors may be pivoted widely, this operation may proceed not only in the region of track 3 but also branch track 15. The amounts of sand and ballast delivered to the conveyors are controlled by operation of baffles 40 and 48.

Additional baffles 47 are arranged at the discharge ends of the chutes separated by baffles 42 so that bed material may be properly delivered to conveyor bands 23, 26 in their position parallel to the machine frame and track 3, as well as in their pivotal end position shown in connection with conveyor 23 in FIG. 2, even if separate materials, i.e. cleaned ballast and sand are to be fed to, and conveyed by, the separated halves of the conveyor bands. Furthermore, additional baffles 48 are associated with the two lower screens 10 and a common drive 49 for both baffles enables the same to be pivoted into a suitable guiding position for the track bed material separated by these screens.

The illustrated arrangement of the pivotal baffles makes it possible roughly to control the amount of cleaned ballast and/or sand fed to distributing conveyors 23, 26 so that considerably more material is delivered to conveyor 23 associated with no-lead chain guide 5 than to the other distributing conveyor. Also, the proper transfer of bed material from the screening apparatus to the distributing conveyors will be assured by the arrangement of chutes 45 perpendicularly to the longitudinal extension of the conveyor bands 23, 26 in their maximum pivotal position. The pivotal baffles 48 enable the bed material excavated from branch track 15 to be properly redistributed under this track.

It is also possible to aid in the control of the distribution of cleaned ballast to conveyors 23 and 26 by pivoting the screening mechanism 9 in the direction of conveyor 23. Furthermore, a longitudinally adjustable slide may be associated with chain guide 6 in the region of chain drive 8. If this slide is moved in the direction of guide 7, the entire excavated track bed material may be transmitted directly to conveyor 13 for removal. When the slide is moved in the opposite direction, the bed material is further entrained by the chain and is accelerated transversely to the longitudinal extension of the machine. This ballast movement may be enhanced by an additional guide baffle which extends obliquely to the longitudinal axis of the machine and is vertically pivotal. In this manner, the excavated material may be thrown to an increased extent to the side of the screening mechanism 9 associated with branch track 15.

When the machine is used for working at a track switch and it runs on the branch track, it may be required to provide support 22 (or 29) for chain guide 6 and support 24 for conveyor 26. However, it is preferred to lengthen the transverse chain guide 7 in the direction of non-load guide 5 since this guide carries not track bed material and, therefore, the tilting moments on this side are smaller.

It will be obvious to those skilled in the art that many modifications and variations in the illustrated mechanisms are possible, particularly in respect to the construction of the chutes, guide baffles, conveyors and drives. The metes and bounds of the invention are accordingly determined by the appended claims.

We claim:

1. In a mobile track maintenance machine useful for work in track switches and crossings, which comprises an endless ballast excavation chain including a chain section mounted for extension transversely of, and below, the track for excavating ballast supporting the track on a subgrade, means mounted on the machine adjacent the excavation chain and remote from the chain section for separating the excavated ballast from fines to produce cleaned ballast, and means mounted on the machine and arranged to receive the cleaned ballast from the separating means for distributing the cleaned ballast and the fines, the improvement of 1. a transversely extending guide for the chain section mounted on the machine and adjustable to selected lengths for a corresponding change in the width of the ballast excavation effectuated by the chain section,
2. the distributing means being adjustable over the entire width of ballast excavation for selectively distributing the cleaned ballast within this width, and
3. mobile support means mounted to support the excavation chain during movement of the machine.

2. In the mobile track maintenance machine of claim 1, the support means being mounted for mobility on the subgrade from which the ballast has been excavated.

3. In the mobile track maintenance machine of claim 1, mobile support means for the distributing means for supporting the distributing means during movement of the machine.

4. In the mobile track maintenance machine of claim 3, the support means being mounted for mobility of the track.

5. In the mobile track maintenance machine of claim 1, the endless ballast excavation chain having additional chain sections, the chain sections being arranged for movement in a polygonal path, and a correspondingly polygonal chain guide assembly including the transversely extending guide and an additional guide preceding the transversely extending guide in the direction of chain movement.

6. In the mobile track maintenance machine of claim 5, the additional guide being connected to the support means.

7. In the mobile track maintenance machine of claim 6, the additional guide being pivotally connected to the support means.

8. In the mobile track maintenance machine of claim 7, the transversely extending guide consisting of a fixed member and about eight to nine removable guide members being insertable in the guide to fix the length of the guide to a maximum width of ballast excavation of two adjacent parallel tracks, and hydraulic motor means for laterally pivoting the additional guide through a pivoting range permitting the insertion of said additional members.

9. In the mobile track maintenance machine of claim 1, the means for separating the excavated ballast from fines being a cleaning screen arranged to receive the excavated ballast from the excavating chain, and guide elements associated with the cleaning screen for selectively guiding the separated materials from the screen for distribution.

10. In the mobile track maintenance machine of claim 9, the screen having three superposed screening elements, constituted by chutes extending obliquely to the plane of the track, the guide elements being associated with each of the screening elements.

11. In the mobile track maintenance machine of claim 10, the distributing means for the cleaned ballast being adjustable to a maximum lateral angle in relation to the axis of the track, the distributing means being conveyor bands, selected ones of the guide elements extending substantially perpendicularly to the conveyor bands at said maximum angle.

12. In the mobile track maintenance machine of claim 10, a ballast guide element associated with each of the screening elements and pivotal about an axis substantially perpendicular to the associated screening element.

13. In the mobile track maintenance machine of claim 1, the fines comprising sand, the means for separating the excavated ballast from the sand comprising two screening elements each having an outlet, the distributing means comprising a conveyor band divided by a central web into two halves, a first chute associated with one of the screening elements and leading to one of the conveyor band halves, a second chute associated with the other screening element and leading to the other conveyor band half, and a cover for the other screening element.

* * * * *